US006227934B1

(12) United States Patent
Isaksson et al.

(10) Patent No.: US 6,227,934 B1
(45) Date of Patent: May 8, 2001

(54) TOY VEHICLE CAPABLE OF PROPELLING ITSELF INTO THE AIR

(75) Inventors: William Isaksson, New York; Paul Dowd, Bronxville, both of NY (US)

(73) Assignee: The Simplest Solution, Bronxville, NY (US)

( * ) Notice: Subject to any disclaimer, the term of this patent is extended or adjusted under 35 U.S.C. 154(b) by 0 days.

(21) Appl. No.: 09/112,870

(22) Filed: Jul. 9, 1998

(51) Int. Cl.[7] ..... A63H 17/00

(52) U.S. Cl. ..... 446/470; 446/437; 446/456; 446/462; 446/465

(58) Field of Search ..... 446/437, 456, 446/457, 462, 465, 470

(56) References Cited

U.S. PATENT DOCUMENTS

| | | | | |
|---|---|---|---|---|
| 1,651,292 | | 3/1927 | Ramage . | |
| 2,182,642 | * | 12/1939 | Rexford | 446/437 X |
| 2,794,295 | | 6/1957 | Robertson . | |
| 3,445,959 | | 5/1969 | Barlow et al. . | |
| 3,772,824 | | 11/1973 | Terzian et al. . | |
| 4,209,942 | | 7/1980 | Lohr . | |
| 4,299,301 | | 11/1981 | Janin . | |
| 4,300,308 | | 11/1981 | Ikeda . | |
| 4,363,187 | | 12/1982 | Shinohara . | |
| 4,426,806 | | 1/1984 | Woodworth . | |
| 4,449,323 | | 5/1984 | Fisher . | |
| 4,457,101 | | 7/1984 | Matsushiro | 446/456 |
| 4,471,567 | | 9/1984 | Martin | 446/437 |
| 4,490,124 | | 12/1984 | Ogawa | 446/464 |
| 4,591,346 | | 5/1986 | Ikeda | 446/437 |
| 4,666,420 | | 5/1987 | Nagano | 446/443 |
| 4,767,376 | | 8/1988 | Hanzawa | 446/457 |
| 4,850,931 | | 7/1989 | Auer | 446/437 |
| 5,131,882 | * | 7/1992 | Kiyokane | 446/470 X |
| 5,259,808 | | 11/1993 | Garr | 446/437 |
| 5,334,075 | | 8/1994 | Kakijazi et al. | 446/438 |
| 5,334,076 | | 8/1994 | Shinozuka | 446/456 |
| 5,618,219 | | 4/1997 | Simone et al. | 446/456 |
| 5,643,041 | | 7/1997 | Mukaida | 446/455 |
| 6,095,890 | * | 8/2000 | George et al. | 446/465 X |

OTHER PUBLICATIONS

"Stunt Boss" vehicle illustrated in Hasboro Group 1995 Toy Fair catalog.

Videotape of "Land Shark" concept displayed in–house at Hasbro, Inc. in the presence of three employees of Target Stores on Jul. 8, 1997. The Target Stores employees were permitted to observe the videotape with an understanding of confidentiality.

* cited by examiner

*Primary Examiner*—John A. Ricci
(74) *Attorney, Agent, or Firm*—Marshall, O'Toole, Gerstein, Murray & Borun

(57) ABSTRACT

A toy vehicle has a curved cam surface on the upper surface of its chassis, with a forward point on a tangent that is relatively close to the center of mass of the vehicle, and a rearward point on a tangent that is relatively far from the center of mass. The vehicle includes a breaking mechanism that can be used to start the vehicle rotating forwardly. As the vehicle rotates, the point of contact between the vehicle and the supporting surface moves from the front wheels to a leading edge and subsequently to the cam surface. As the vehicle rotates with the cam surface in contact with the supporting surface, the center of mass of the vehicle is forced upwardly, providing sufficient momentum to propel the vehicle into the air.

19 Claims, 4 Drawing Sheets

TOY VEHICLE CAPABLE OF PROPELLING ITSELF INTO THE AIR

FIELD AND BACKGROUND OF THE INVENTION

This invention relates to toy vehicles and more particularly to vehicles that can move across a surface and be controlled to propel themselves into the air.

Many types of toy vehicles have been provided with rods or feet that extend outwardly from the chassis of the vehicle and press against the ground to push the chassis away from the ground or other supporting surface. The cars described in U.S. Pat. Nos. 5,618,219 and 4,490,124, for example, each include a pivoting member on the bottom of the chassis. When activated, the member pivots, striking the supporting surface with a force sufficient to lift the vehicle into the air. The impact results in highly variable tumbling.

One problem with such vehicles, however, is that the feet or rods used to provide the impact are prone to breakage. It would also be desirable to provide a more efficient way to propel a vehicle into the air, preferably one that provides more consistent results than provided with conventional designs.

SUMMARY OF THE INVENTION

The applicants have designed a new toy that can be efficiently propelled into the air without the need for extending feet or rods, and provides more consistent air travel.

The design includes a braking mechanism that can be used to transform part of a forward momentum of the vehicle into rotational energy. The braking mechanism provides sufficient force to cause the vehicle to rotate forwardly, initially with the front wheels in contact with the supporting surface. As the vehicle rotates forwardly, the point of contact between the rotating vehicle and the supporting surface progresses forwardly along the circumference of the front wheels. As the vehicle continues to rotate forwardly, the point of contact moves to a leading edge on the chassis of the vehicle, and subsequently to a fixed cam surface formed on the top of the chassis.

The cam surface lies on a curve arranged so that, as contact between the supporting surface and the cam surface moves along the cam surface, rotation of the vehicle causes the center of mass of the vehicle to be lifted away from the supporting surface. This lifting action provides the upward momentum necessary to propel the vehicle into the air.

DETAILED DESCRIPTION OF THE DRAWINGS

Figure 1:
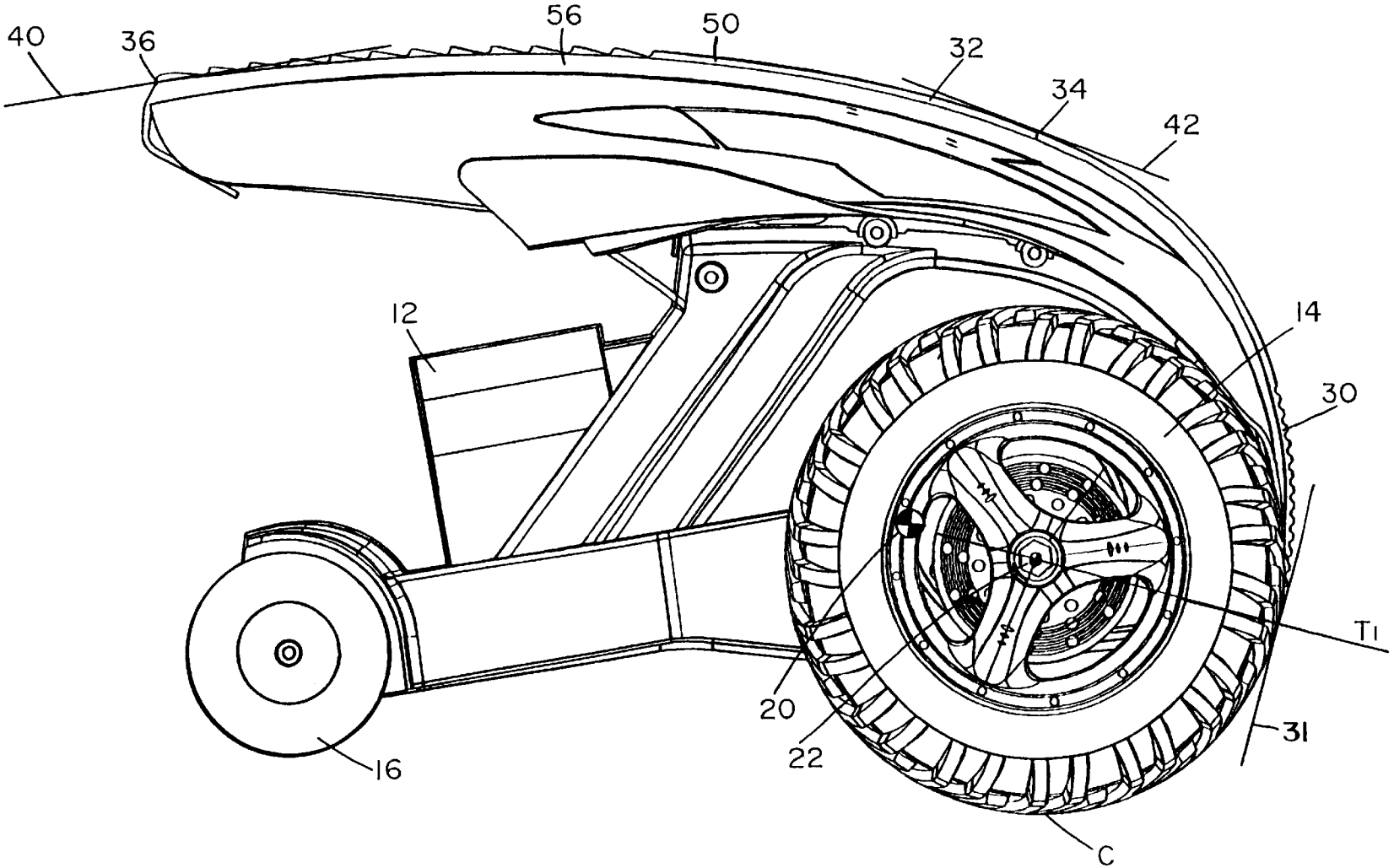
FIG. 1 is a side view of one embodiment of a toy vehicle in accordance with the present invention.
Figure 2:
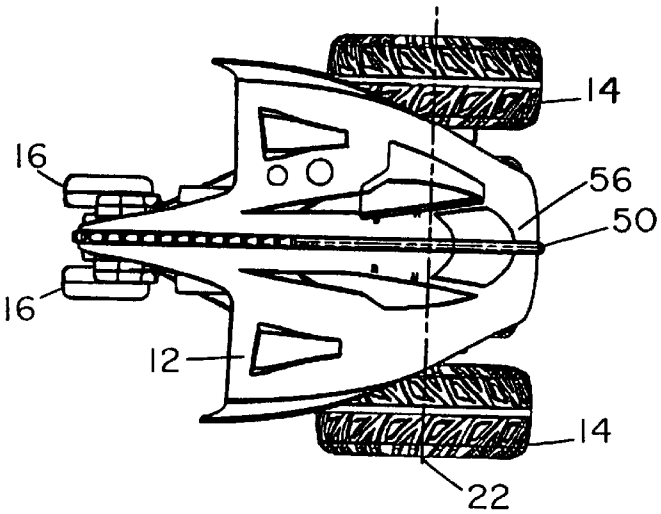
FIG. 2 is a reduced top view of the vehicle of FIG. 1.
Figure 3:
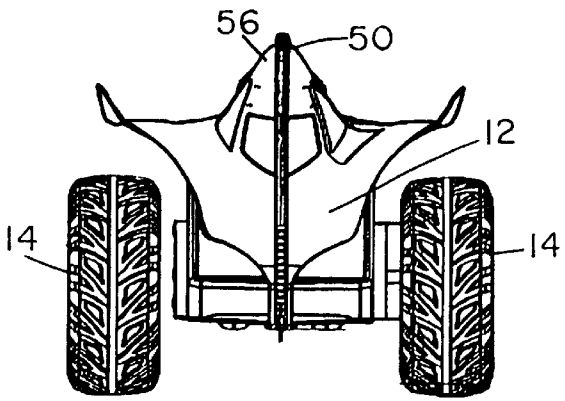
FIG. 3 is a reduced front view of the vehicle.
Figure 4:
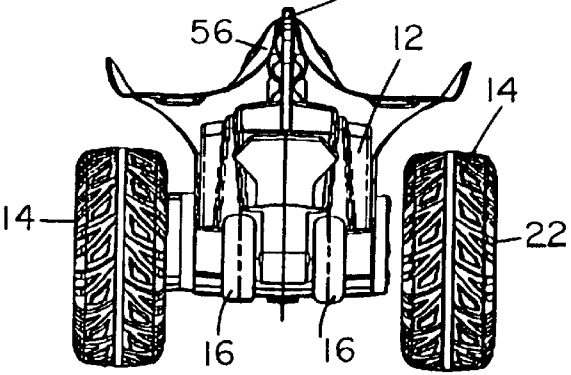
FIG. 4 is a reduced back view of the vehicle.
Figure 5:
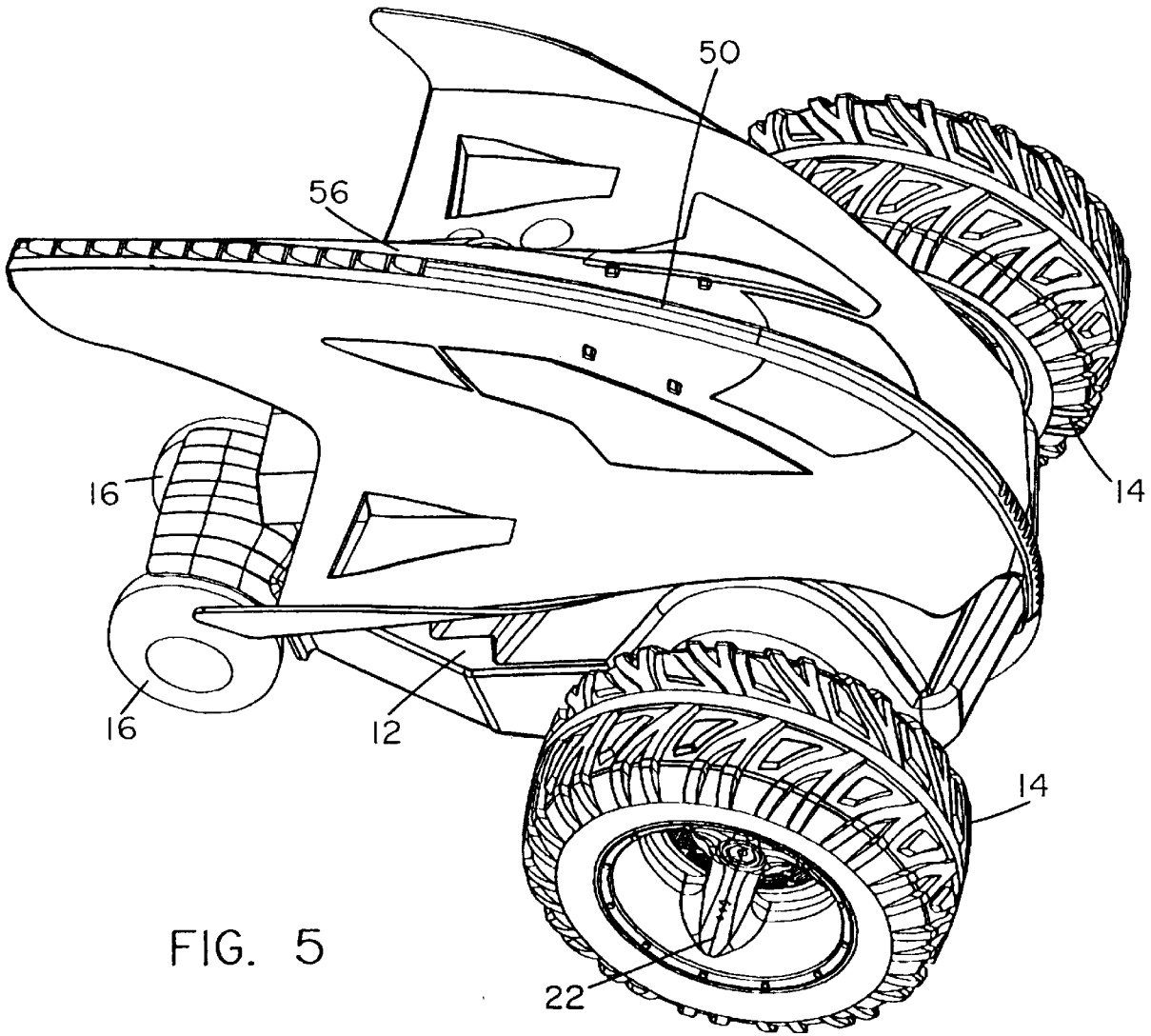
FIG. 5 is a perspective view of the vehicle.

The figures illustrate one embodiment of a toy vehicle 10 in accordance with the present invention. As seen in FIGS. 1 and 5, the vehicle has a chassis 12, a set of front wheels 14, and a set of back wheels 16. An internal R/C unit (not shown) allows the unit to be radio-controlled. The illustrated vehicle weighs about forty-four ounces when loaded with a battery, and is about 11 inches long, 10 inches wide, and 7½ inches high. The vehicle's center of mass 20 is located about 3¼ inches above the supporting surface.

As illustrated, the front wheels 14 are mounted on powered front axles 22, which are positioned about 1½ inches in front of the center of mass 20. The front wheels have a diameter of approximately 5 inches and are positioned about 8 inches apart. The unpowered back wheels 16 have a smaller diameter, only about 2 inches, and are positioned about 2 inches apart.

As illustrated, the vehicle 10 includes a battery, a motor for each wheel, and gearing (not shown) that allow the vehicle to be driven forwards at a speed of approximately 12 mph. The vehicle is also provided with structure allowing it to be braked with sufficient force to cause the vehicle to rotate forwardly; i.e, to cause the back wheels 16 to lift off the supporting surface. As illustrated, braking is initiated by a conventional switch (not shown) that allows the front wheels 14 to be powered in reverse. The front wheels are made of rubber, and may serve as a brake. When the illustrated vehicle is moving forwardly at sufficient speed, the friction caused by reversing the front wheels is sufficient, on most supporting surfaces, to cause the vehicle to begin rotating about the front axis 22, with the back wheels 16 lifting off the supporting surface.

Figure 6:
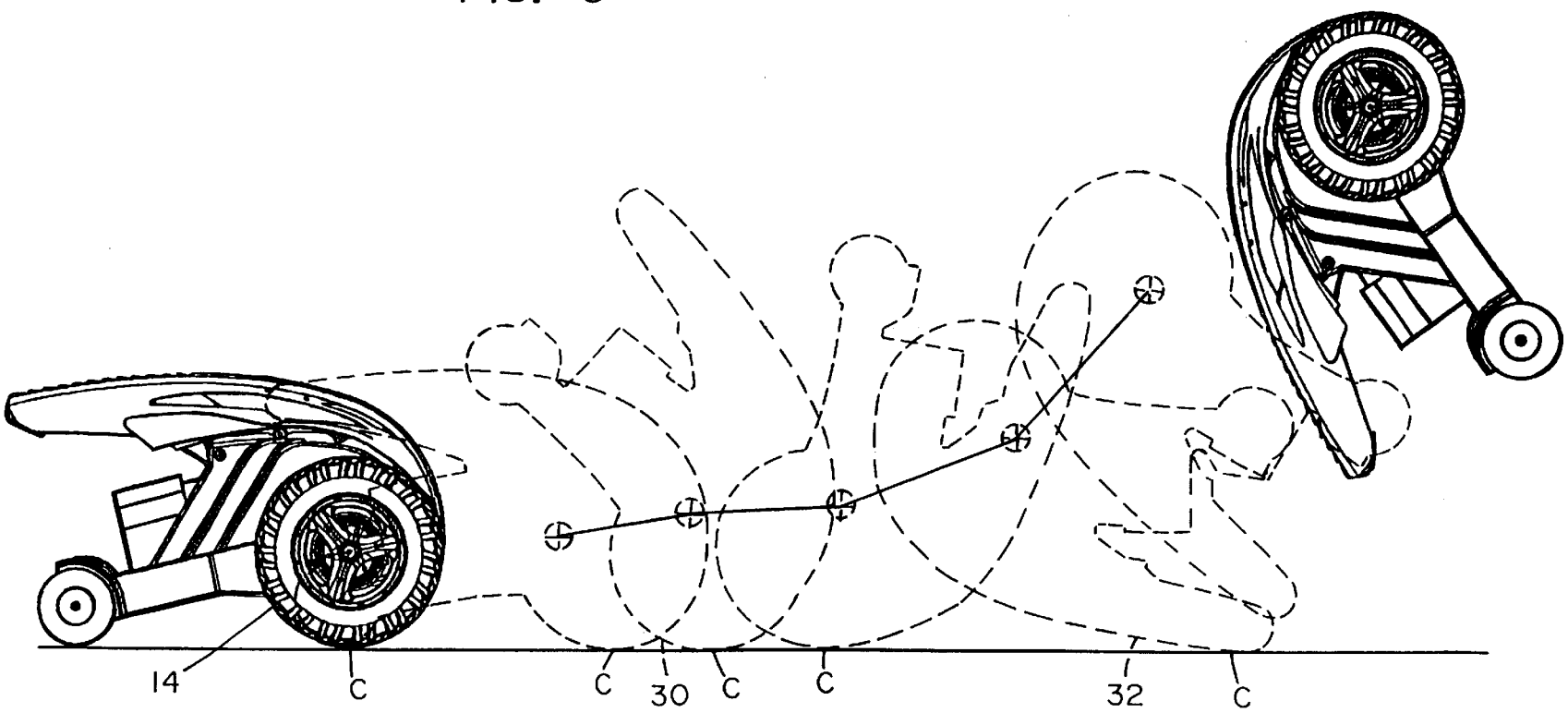
FIG. 6 is a sequential view of the vehicle as it is propelled into the air.

As seen in FIG. 6, initial rotation occurs with the front wheels 14 remaining in contact with the supporting surface. The point of contact C between the vehicle 10 and the supporting surface moves forwardly about the circumference of the front wheels 14 as the vehicle rotates forwardly.

As the vehicle 10 continues to rotate forwardly, the point of contact between the vehicle and the supporting surface moves from the circumference of the front wheels 14 to a leading edge 30 on the chassis 12. The leading edge is designed to provide a smooth transition from rotation of the vehicle with the front wheels in contact with the supporting surface to rotation with the chassis in contact with the supporting surface. This smooth transition is achieved by forming the leading edge as a curve that begins as a tangent to the circumference of the front wheels.

As illustrated in FIG. 1, the leading edge 30 begins at a tangent 31 that passes through the front axle 22 and near the center of mass 20. Upwardly of this point, the distance from the center of the mass to the circumference of the front wheels 14 begins to decrease as one continues to move about the circumference of the front wheels. Use of the tangent 31 as the starting point for the leading edge (i.e., moving the point of contact from the wheels to the chassis at this point) permits contact between the vehicle 10 and the supporting surface to be maintained as the vehicle rotates forwardly, without the center of mass moving downwardly.

As illustrated, the leading edge 30 lies on an arc of a circle centered near the center of mass 20. Using this configuration, the center of mass is maintained at a generally constant height above the supporting surface as the vehicle 10 rotates forwardly with the point of contact C between the vehicle and the supporting surface moving progressively upwardly along the leading edge. As illustrated, the center of this arc is slightly above the center of mass. This helps the vehicle to be self-righting; i.e., the vehicle, if placed at rest in an upside down position, will tend to roll over onto its wheels.

Other configurations of the leading edge may also be acceptable. It is preferred, however, that the distance from the center of mass 20 to the leading edge 30 not significantly decrease as one moves along the leading edge away from the front wheels 14. Arranging the leading edge on an arc of a circle is believed to provide the most efficient design for doing so.

As illustrated, the leading edge 30 extends through an arc of approximately 90 degrees, as measured from the center of mass 20, starting at a point about 30 degrees below horizontal from the center of mass and ending at a point about 60 degrees above horizontal from the center of mass. Longer or shorter leading edges may also be provided to create different aesthetic looks, and the leading edge could even be omitted entirely.

The primary lifting force used to propel the vehicle 10 into the air is developed as the vehicle rotates with the point of contact C between the vehicle and the supporting surface moving along a fixed cam surface 32 formed on top of the chassis 12. As illustrated, the cam surface is around 10 inches long. It is believed that good results can be obtained so long as the cam surface is at least about 75–80% of the length of the vehicle.

The cam surface 32 lies on a curve that begins at a cam initiation point 34 adjacent the leading edge 30 and terminates at a rearward point 36. Both points, and all intermediate points on the curve of the cam surface, have tangents that lie at various distances from the center of mass 20. At any particular point in the rotational movement of the vehicle 10 across the supporting surface, the tangent through the point of the cam surface 32 that forms the contact point C between the cam surface and the supporting surface is collinear with the supporting surface.

The angle between 1) a line from the point of contact C to the center of mass 20 and 2) a perpendicular to the cam surface 32 at the point of contact C may be viewed as a pole vault angle $\alpha$. Preferably, the pole vault angle at the cam initiation point 34 is approximately zero degrees; in other words, when the vehicle 10 rotates to the position where the cam initiation point comes into contact with the ground, the center of mass is directly above the point of contact. The pole vault angle increases as one moves rearwardly along the cam surface 32. Good jumping can be achieved with pole vault angles at the rearward point as small 25 degrees. Greater angles provide the opportunity for higher jumping, but it if the angle is too great the vehicle will begin to merely skid across the supporting surface. The angle at which skidding occurs depends upon the coefficient of friction of the materials involved. In the illustrated embodiment, the pole vault angle at the rearward point 36 is approximately 55 degrees. As a result, when the toy leaves the ground, the center of mass is traveling upwards at an angle 55 degrees above horizontal.

A smooth increase in the pole vault angle from the cam initiation point to the rearward point (that is, an overall increase that does not include any abrupt or non-continuous changes in angle, such as an instantaneous change from a 5° angle to a 10° angle) has been found to be particularly efficient for producing good jumping.

The height of the center of mass 20 of the vehicle at any point in its rotational movement is equal to the distance between the tangent through the point of the cam surface that forms the point of contact C and the center of mass 20. The distance from the center of mass to the tangent 40 through the rearward point 36 is greater than the distance from the center of mass to the tangent 42 through the cam initiation point 34. Because the distance from the center of mass to the tangent 40 through the rearward point 36 is greater than the distance from the center of mass to the tangent 42 through the cam initiation point 34, the center of mass of the vehicle is forced upwardly as the point of contact between the vehicle and the supporting surface progresses rearwardly from the cam initiation point to the rearward point.

In the illustrated embodiment, the distance from the center of mass 20 to the tangent 42 through the cam initiation point 34 is approximately 4 inches, and the distance from the center of mass to the tangent 40 through the rearward point 36 is approximately 5 inches. The illustrated smooth increase in the pole vault angle $\alpha$ from about 0° at the cam initiation point 34 to approximately 55° at the rearward point 36 results in the distances from the center of mass to the tangents through intermediate points on the cam surface smoothly increasing as one progresses rearwardly from the cam initiation point. As a result of this configuration, the center of the mass of the vehicle is smoothly accelerated upwardly as the vehicle rotates with the point of contact with the supporting surface moving rearwardly along the cam surface.

As illustrated, the vehicle 10 is made primarily of PVC or polypropylene plastic. A relatively thin rubber strip 50 has been added to the center line of the upper surface 52 of the chassis 12. The rubber strip has a good coefficient of friction with respect to typical supporting surfaces, such as linoleum, short carpet, asphalt, or concrete. The relatively high coefficient of friction helps to transmit force between the supporting surface and the vehicle in order to continue the forward rotation of the vehicle. Without such a structure on the illustrated vehicle, the vehicle might stop rotating and begin to simply skid across some supporting surfaces when the point of contact C between the vehicle and the supporting surface moves from the front wheels 14 to the upper surface of the chassis. Such skidding may be particularly troublesome when the point of contact moves to the cam surface, because at those points rotational momentum is needed to raise the center of mass 20 of the vehicle. The rubber strip also provides cushioning when the vehicle lands in an upside-down position.

This detailed description of the drawings is meant for clearness of understanding only, and no unnecessary limitations from this description should be read into the following claims.

What is claimed is:

1. A toy vehicle comprising:

a chassis having an upper surface and a center of mass;

a set of front wheels;

a cam surface on the upper surface of the chassis, the cam surface lying on a curve that extends from a cam surface initiation point that lies at a relatively short distance from the center of mass to a rearward point that lies at a relatively long distance from the center of mass; and means for braking the vehicle with a force sufficient to cause the vehicle to rotate forwardly to bring the cam surface into contact with the ground, the rotation of the vehicle with the cam surface in contact with the ground causing the center of mass to be lifted upwardly with sufficient force to cause the toy to subsequently become airborne.

2. A vehicle as recited in claim 1, in which a line from the cam surface initiation point to the center of mass is perpendicular to the cam surface at the cam surface initiation point.

3. A vehicle as recited in claim 1, in which the angle between 1) a line from the rearward point to the center of mass and 2) a perpendicular to the cam surface at the rearward point forms an angle of at least about 25 degrees.

4. A vehicle as recited in claim 1, in which the cam surface is at least about 75–80% of the length of the vehicle.

5. A vehicle as recited in claim 1, in which the upper surface of the chassis comprises a leading edge that extends from a tangent to the circumference of the front wheels to the cam initiation point.

6. A vehicle as recited in claim 1, in which a pole vault angle between 1) a line from a point on the cam surface to the center of mass and 2) a perpendicular to the cam surface at that point smoothly increases as one moves rearwardly along the cam surface from the cam initiation point.

7. A toy vehicle comprising:

a chassis having an upper surface and a center of mass;

a set of front wheels on an axis;

a leading edge on the chassis, the leading edge extending along a curve that traverses from a tangent to the circumference of the wheels to a cam surface initiation point on a tangent that lies at a relatively short distance from the center of mass;

a cam surface on the upper surface of the chassis, the cam surface lying on a curve that extends from the cam surface initiation point to a rearward point on a tangent that lies at a relatively long distance from the center of mass; and means for braking the vehicle with a force sufficient to cause the vehicle to rotate forwardly to bring the cam surface into contact with the ground, the rotation of the vehicle with the cam surface in contact with the ground causing the center of mass to be lifted upwardly with sufficient force to cause the toy to subsequently become airborne.

8. A vehicle as recited in claim 7, in which the cam surface has a coefficient of friction against linoleum that is greater than the coefficient of friction of plastic.

9. A vehicle as recited in claim 7, in which the cam surface includes a rubber strip.

10. A vehicle as recited in claim 7, in which the cam surface lies on a curve the tangents to which lie at continuously increasing distances from the center of mass as one moves from the cam surface initiation point to the rearward point.

11. A vehicle as recited in claim 7, in which a pole vault angle between 1) a line from a point on the cam surface to the center of mass and 2) a perpendicular to the cam surface at that point on the cam surface smoothly increases as one moves rearwardly along the cam surface from the cam initiation point.

12. A vehicle as recited in claim 7, in which a line from the cam surface initiation point to the center of mass is perpendicular to the cam surface at the cam surface initiation point.

13. A vehicle as recited in claim 7, in which the leading edge lies on a segment of a circle, the center of which is near the center of mass.

14. A vehicle as recited in claim 7, in which a line from the cam surface initiation point through the center of mass forms an angle of about 60 degrees to the horizontal.

15. A vehicle as recited in claim 7, in which the leading edge begins as a perpendicular to a line passing through the axis and near the center of mass.

16. A vehicle as recited in claim 7, in which the chassis is made predominantly of plastic and the vehicle is leading edge comprises a rubber strip.

17. A vehicle as recited in claim 7, in which the means for braking the front wheels comprises a means for rotating the wheels in an opposite direction.

18. A vehicle as recited in claim 7, in which the chassis is made predominantly of plastic and the leading edge and the cam surface are formed of a single rubber strip.

19. A vehicle as recited in claim 7, in which the leading edge lies on a circle centered above the center of mass, resulting in the vehicle tending to roll onto its wheels when placed at rest with the leading edge in contact with a supporting surface.

* * * * *